US007575466B2

(12) United States Patent
Ishizuka et al.

(10) Patent No.: US 7,575,466 B2
(45) Date of Patent: Aug. 18, 2009

(54) ELECTRICAL CONNECTOR

(75) Inventors: Shinya Ishizuka, Tokyo (JP); Akio Yamada, Tokyo (JP); Kazuyuki Ozai, Tokyo (JP); Hiromichi Kato, Tokyo (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 12/013,327

(22) Filed: Jan. 11, 2008

(65) Prior Publication Data

US 2008/0214050 A1 Sep. 4, 2008

(30) Foreign Application Priority Data

Mar. 2, 2007 (JP) ..... 2007-053003
Apr. 26, 2007 (JP) ..... 2007-116429

(51) Int. Cl.
*H01R 13/58* (2006.01)

(52) U.S. Cl. ..... 439/468

(58) Field of Classification Search ..... 439/467, 439/723, 607–610, 557
See application file for complete search history.

(56) References Cited

U.S. PATENT DOCUMENTS 6,948,980 B2 * 9/2005 Xiang et al. ..... 439/607
6,971,915 B1 * 12/2005 Mao et al. ..... 439/607
7,413,467 B1 * 8/2008 Lai et al. ..... 439/489
2005/0026500 A1 * 2/2005 Ji et al. ..... 439/607
2008/0057795 A1 * 3/2008 Chen ..... 439/723

FOREIGN PATENT DOCUMENTS

JP 11026105 A 1/1998
JP 10302863 A 11/1998
JP 2003288967 A 10/2003

* cited by examiner

*Primary Examiner*—Jean F Duverne
(74) *Attorney, Agent, or Firm*—Sughrue Mion, PLLC; Ernest C. Huang

(57) ABSTRACT

An electrical connector to be detachably fitted with a mating connector, including a plurality of contacts, a housing for arranging and holding the contacts, and a shell covering the housing and forming with the housing a fitting opening for the mating connector. The shell has at least one engaging piece, and the housing has an anchoring portion at a location corresponding to the engaging piece to cause the anchoring portion to engage the engaging piece, thereby restraining the housing from being displaced in the direction opposite to the fitting direction upon fitting with the mating connector. Even being miniaturized, the electrical connector is securely positioned relative to the mating connector when fitting with it, and the housing is securely prevented from being displaced upon the mating connector abutting against the housing, thereby completely preventing any defective connection.

21 Claims, 8 Drawing Sheets

ELECTRICAL CONNECTOR

BACKGROUND OF THE INVENTION

This invention relates to an electrical connector for use in electric and electronic appliances such as mobile phones, and more particularly to an electrical connector with a structure for preventing a housing from being pushed when fitting with a mating connector.

An electrical connector hitherto used will be explained. The electrical connector comprises at least a plurality of contacts to be connected to a substrate, a housing for arranging and holding said contacts, and a shell having holding means for covering and holding said housing.

Said housing is fitted into said shell by press-fitting (with crush ribs) so as to be held in (fixed to) said shell, and when a mating connector is being fitted with the electrical connector, the mating connector is positioned by its abutment against said housing. As examples of electrical connectors, incorporated herein are three patent literatures: Patent Literature 1 (Japanese Patent Application Opened No. 2003-288,967), Patent Literature 2 (Japanese Patent Application Opened No. H10-302,863/1998) and Patent Literature 3 (Japanese Patent Application Opened No. H11-26,105/1999) including applications proposed by the applicant of the present application.

Patent Literature 1

According to the abstract of the Japanese Patent Application Opened No. 2003-288,967, this invention has an object to provide a receptacle connector achieving its miniaturization by shortening its depth dimension and having a structure preventing foreign substances, dust, moisture and the like from entering the interior of the connector through its housing. Disclosed therein is a connector comprising a box-shaped insulating housing 10 having an insert end 11 to be inserted into the plug of a plug connector and a rear plate 12 formed at a location opposite to the insert end 11, a plurality of terminals 30 installed in the housing, a conductive metal shell 20 covering the housing, a plurality of inserting openings 17 provided in the bottom of the housing for inserting the respective terminals from the bottom into the housing when the respective terminals are installed into the housing, anchor portions 33 provided on the respective terminals for fixing the respective terminals to the housing, and a plurality of anchor grooves 18 formed in the housing for inserting the anchor portions of the respective terminals therein.

Patent Literature 2

According to the abstract of the Japanese Patent Application Opened No. H10-302,863/1998, this invention has an object to provide an electrical connector to be mounted on a circuit board, ensuring a wide space in front of the fitting portion of a mating electrical connector without decreasing the mounting area of the printed circuit board. Disclosed therein is an electrical connector 1 to be mounted on a circuit board, comprising an insulating housing 3 having a plurality of terminals 2 installed therein, and a metal shell 4 fitted on the housing 3 and having mounting legs 14*a* and 14*b* extending from the metal shell 4 for attaching the metal shell 4 to the printed circuit board 15, and the respective terminals 2 each having a tail 19 extending therefrom to a conductive circuit on the printed circuit board 15. The metal shell 4 forms a fitting portion 8 in front of the insulating housing 3 for receiving a mating electrical connector 21, and the fitting direction A of the fitting portion 8 is set to an upwardly inclined direction relative to the surface 15*a* of the printed circuit board 15 through the mounting legs 14*a* and 14*b*.

Patent Literature 3

According to the abstract of the Japanese Patent Application Opened No. H11-26,105/1999, this invention has an object to provide an electrical connector 10 enabling stable contact pressure without contacts 14 being buckled, without the contacts 14 being raised from an insulator 12, without a shell 16 being deformed, and without being affected by noise effect even after the connector is repeatedly inserted into and removed from a mating connector 40 very many times. Disclosed therein is a connector comprising a shell 16 having on both sides in its width direction plate-shaped pieces 18 extending to the proximity of a fitting opening, the plate-shaped pieces 18 being provided in the proximity of their tips with fixing legs 20 extending in the same direction as fixing legs A30, and the plate-shaped pieces 18 on the side of the fixing legs 20 further being provided with anchoring portions 24, and further the shell 16 being provided with an engaging portions 22 at locations enabling the anchoring portions 24 to be fitted in the engaging portions 22, and an insulator 12 including a projection 50 having contact inserting grooves 52, on both sides of which protrusions 54 are provided, and in the proximity of the free end of the projection 50 a taper portion 56 being provided to be continuous with the protrusions 54.

Recently, as the electric and electronic appliances have been progressively miniaturized, the requirement for miniaturization of electrical connectors has become stronger.

A housing is frequently held (fixed) in a shell by press-fitting (with crush ribs) as described in the above paragraph of the prior art and as disclosed in the Patent Literatures 1 to 3. Moreover, with the miniaturization of the connectors, the interference (size of crush ribs) for press-fitting has become smaller. When an electrical connector and a mating connector are fitted with each other, positioning of one relative to the other is effected by the abutment of the mating connector against the housing of the electrical connector as described in the paragraph of the prior art. The contacts held in the housing are connected to a substrate by soldering.

With such a construction disclosed in the prior art, when the electrical connector is being fitted with the mating connector, the housing would be likely to move in the fitting direction of the mating connector (in the opposite direction of the fitting opening) by being pushed by the mating connector, thereby resulting in defective or failed connection between the electrical connector and the mating connector. This problem remains to be solved.

SUMMARY OF THE INVENTION

The present invention has been completed in view of the problems of the prior art and has an object to provide an electrical connector which enables its positioning relative to a mating connector with great certainty when fitting with a mating connector even the electrical connector being miniaturized and whose housing is securely prevented from being displaced when the mating connector abuts against the housing, thereby completely preventing any defective or failed connection.

The object of the invention is achieved by the electrical connector 10 claimed in claim 1 to be detachably fitted with a mating connector, comprising a plurality of contacts 14, a housing 12 for arranging and holding said contacts 14, and a shell 16 covering said housing 12 and forming with said housing 12 a fitting opening 40 for said mating connector, wherein said shell 16 is provided with at least one engaging piece 42 and said housing 12 is provided with an anchoring portion 24 at a location corresponding to said engaging piece 42 to cause said anchoring portion 24 to engage said engaging piece 42, thereby restraining said housing 12 from being displaced in the direction opposite to the fitting direction when the electrical connector is being fitted with the mating connector.

In the invention claimed in claim 2, said shell 16 is provided with plate-shaped pieces 56 on both side in its width direction on the opposite side of the fitting opening 40, and said plate-shaped pieces 56 are each formed on the inner side with an oblique slit 58 so that said plate-shaped pieces 56 are bent along said oblique slits to push said housing 12 toward the fitting opening by said plate-shaped pieces 56 for pushing and holding said housing 12 toward the fitting opening.

In the invention claimed in claim 3, said shell 16 is provided with at least one abutment face 52 and said housing 12 is brought into abutment against said abutment face 52, thereby positioning said housing 12 in the fitting direction.

In the invention claimed in claim 4, said shell 16 is provided with a projecting piece 60 formed integrally therewith on the opposite side of the fitting opening 40, and said projecting piece 60 is connected to a substrate 80.

In the invention claimed in claim 5, said shell 16 is provided on the opposite side of the fitting opening 40 with a static electricity countermeasure wall (EMI countermeasure wall) 54 covering the connecting side of said housing 12, and said static electricity countermeasure (EMI countermeasure wall) 54 is provided with a projecting piece 60 formed integrally therewith, said projecting piece 60 being connected to a substrate 80.

In the invention claimed in claim 6, said plate-shaped piece 56 is further extended toward said substrate 80 to form said projecting piece 60.

As can be seen from the above description, the electrical connector according to the invention brings about the following significant effects.

(1) According to the invention claimed in claim 1, the electrical connector is constructed to be detachably fitted with a mating connector and comprises a plurality of contacts 14, a housing 12 for arranging and holding said contacts 14, and a shell 16 covering said housing 12 and forming with said housing 12 a fitting opening 40 for said mating connector, wherein said shell 16 is provided with at least one engaging piece 42 and said housing 12 is provided with an anchoring portion 24 at a location corresponding to said engaging piece 42 to cause said anchoring portion 24 to engage said engaging piece 42, thereby restraining said housing 12 from being displaced in the direction opposite to the fitting direction when the electrical connector is being fitted with the mating connector. Therefore, even when the electrical connector 10 is miniaturized, the electrical connector is securely positioned relative to the mating connector when being fitted with it, and when the mating connector abuts against the electrical connector 10, the housing 12 is securely prevented from being displaced, thereby preventing any defective or failed connection.

(2) According to the invention claimed in claim 2, said shell 16 is provided with plate-shaped pieces 56 on both side in its width direction on the opposite side of the fitting opening 40, and said plate-shaped pieces 56 are each formed on the inner side with an oblique slit 58 so that said plate-shaped pieces 56 are bent along said oblique slits to push said housing 12 toward the fitting opening by said plate-shaped pieces 56 for pushing and holding said housing 12 toward the fitting opening. Consequently, when said housing 12 is installed and held in said shell 16, said housing 12 is securely positioned relative to the shell 16, and even when the electrical connector 10 is miniaturized, the electrical connector 10 is securely positioned relative to the mating connector when the electrical connector is being fitted with the mating connector, and upon the mating connector abutting against the electrical connector 10, the housing 12 is prevented from being displaced so that no defective or failed connection occurs.

(3) According to the invention claimed in claim 3, said shell 16 is provided with at least one abutment face 52 and said housing 12 is brought into abutment against said abutment face 52, thereby positioning said housing 12 in the fitting direction. Therefore, even when the electrical connector 10 is miniaturized, the electrical connector 10 is securely positioned relative to the mating connector when the electrical connector is being fitted with the mating connector, and upon the mating connector abutting against the electrical connector 10, the housing 12 is prevented from being displaced so that no defective or failed connection occurs.

(4) The invention claimed in claim 4, said shell 16 is provided with a projecting piece 60 formed integrally therewith on the opposite side of the fitting opening 40, and said projecting piece 60 is connected to a substrate 80. Accordingly, the electrical connector 10 can be securely positioned relative to the substrate 80 and further even when the mating connector abuts against the electrical connector 10, the housing 12 is securely prevented from being displaced to enhance the strength of the electrical connector 10 and to prevent any defective or failed connection.

(5) The invention claimed in claim 5, said shell 16 is provided on the opposite side of the fitting opening 40 with a static electricity countermeasure wall (EMI countermeasure wall) 54 covering the connecting side of said housing 12, and said static electricity countermeasure (EMI countermeasure wall) 54 is provided with a projecting piece 60 formed integrally therewith, said projecting piece 60 being connected to a substrate 80. Consequently, the electrical connector 10 can be securely positioned relative to a substrate 80 and further even when the mating connector abuts against the electrical connector 10, the housing 12 is securely prevented from being displaced to enhance the strength of the electrical connector 10, to prevent any defective or failed connection, and to effectively achieve a countermeasure against static electricity.

(6) The invention claimed in claim 6, said plate-shaped piece 56 is further extended toward said substrate 80 to form said projecting piece 60. Therefore, the electrical connector 10 can be securely positioned relative to a substrate 80, and further even when the mating connector abuts against the electrical connector 10, the housing 12 is securely prevented from being displaced to enhance the strength of the electrical connector 10 and to prevent any defective or failed connection.

The invention will be more fully understood by referring to the following detailed specification and claims taken in connection with the appended drawings.

BRIEF DESCRIPTION OF THE DRAWINGS

FIG. 2 (B) is a perspective view of the shell viewed from the connecting side;

FIG. 3 (B) is a perspective view of the housing in the same state in FIG. 3 (A) viewed from the connecting side;

FIG. 5 (B) is a perspective view of the shell in the same state as shown in FIG. 5 (A) viewed from the connecting side;

FIG. 6 (B) is a perspective view of the electrical connector whose housing is pushed by plate-shaped pieces, viewed from the connecting side;

FIG. 7 (B) is a perspective view of a further electrical connector viewed from the side connecting to a substrate;

FIG. 7 (C) is a perspective view of an electrical connector viewed from the side connecting to a substrate;

FIG. 8 (B) is a perspective view of the electrical connector shown in FIG. 7 (B) connected to the substrate; and FIG. 8 (C) is a perspective view of the electrical connector shown in FIG. 7 (C) connected to the substrate.

DESCRIPTION OF THE PREFERRED EMBODIMENTS

Figure 1:
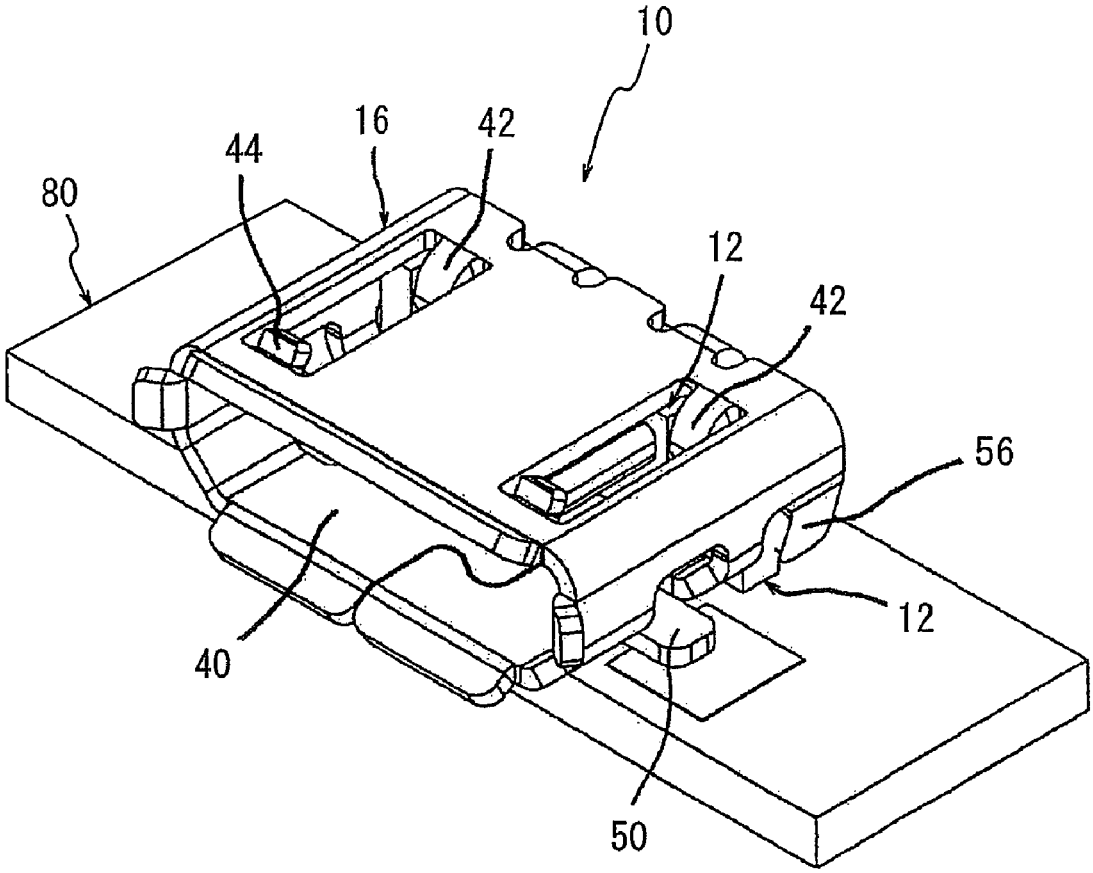
FIG. 1 is a perspective view of the electrical connector connected to a substrate, viewed from its fitting side.
Figure 2A:
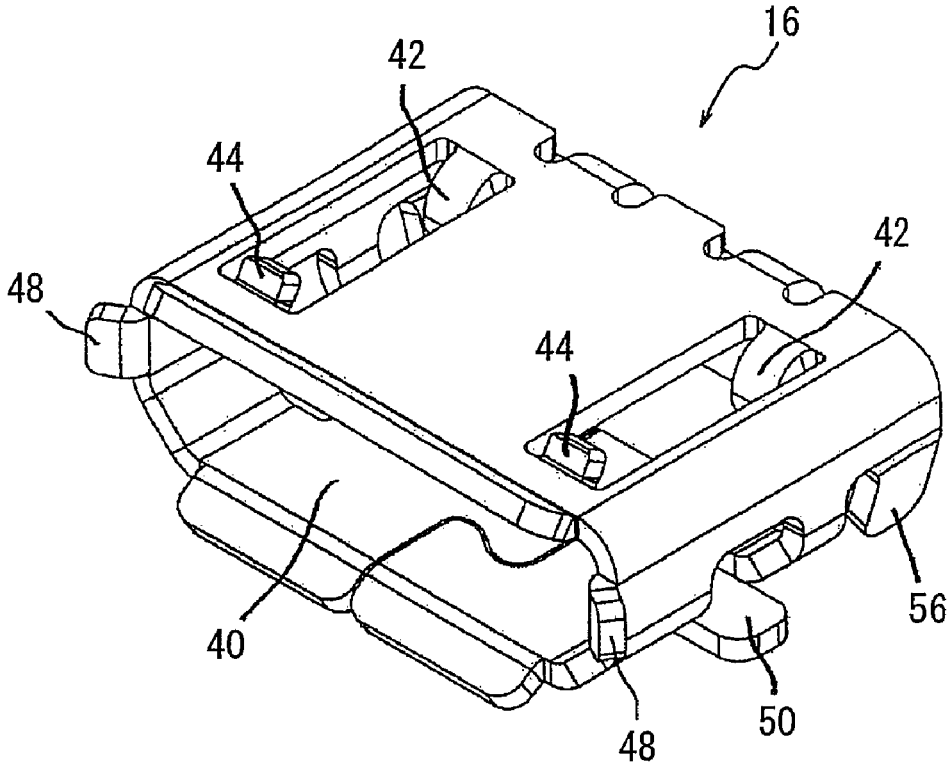
FIG. 2 (A) is a perspective view of a shell of the electrical connector viewed from its fitting opening side.
Figure 2B:
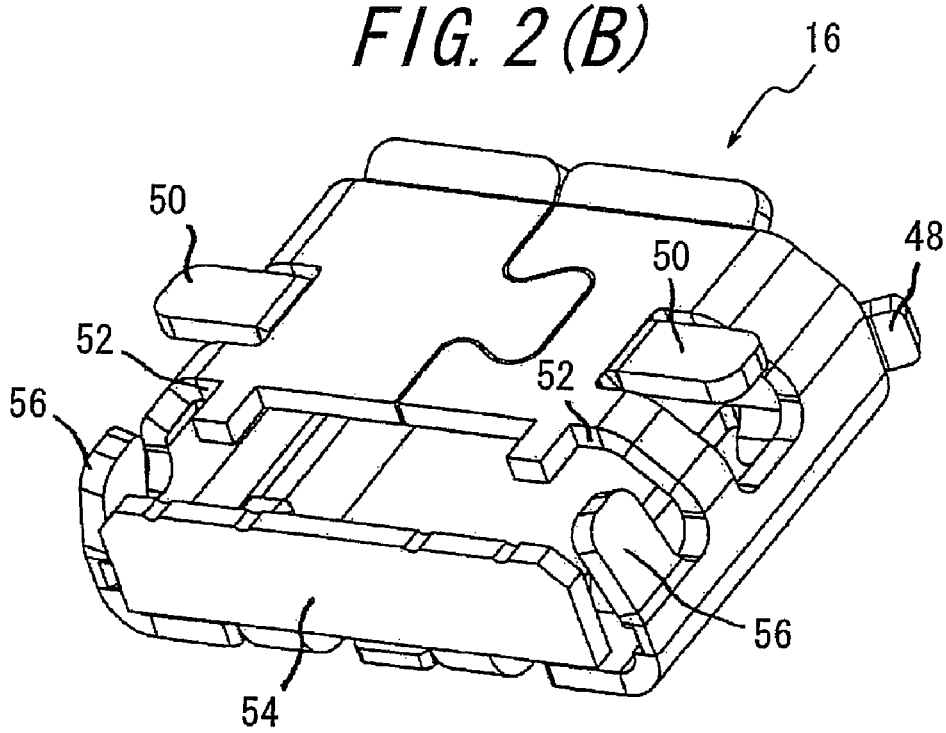
Figure 3:
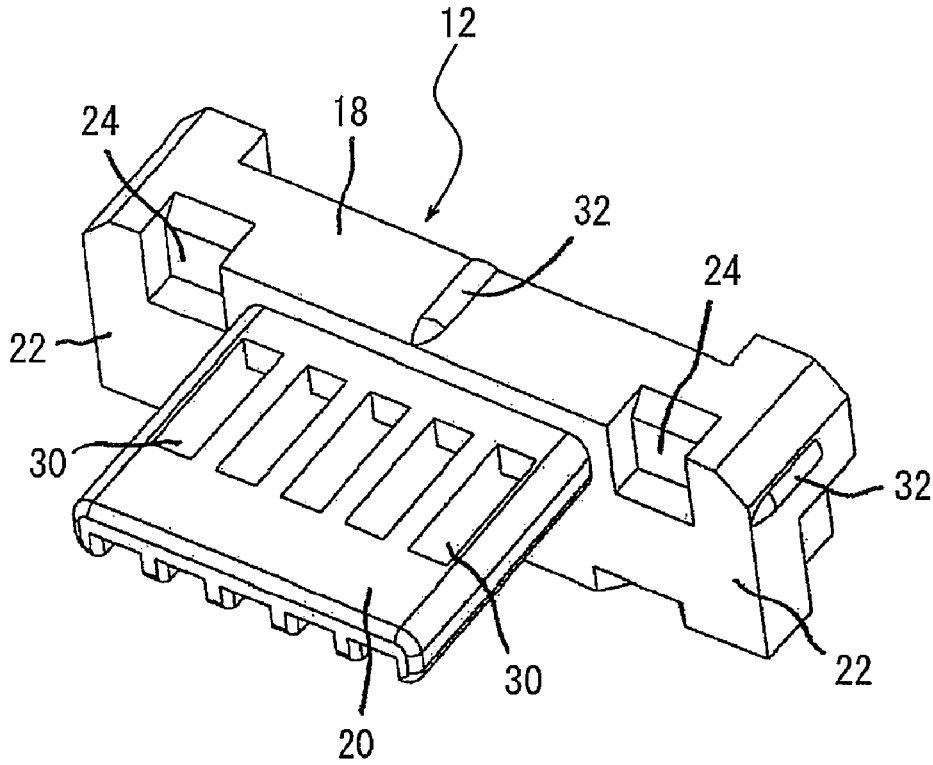
FIG. 3 (A) is a perspective view of the housing of the electrical connector with contacts inserted, viewed from the fitting side.
Figure 3:
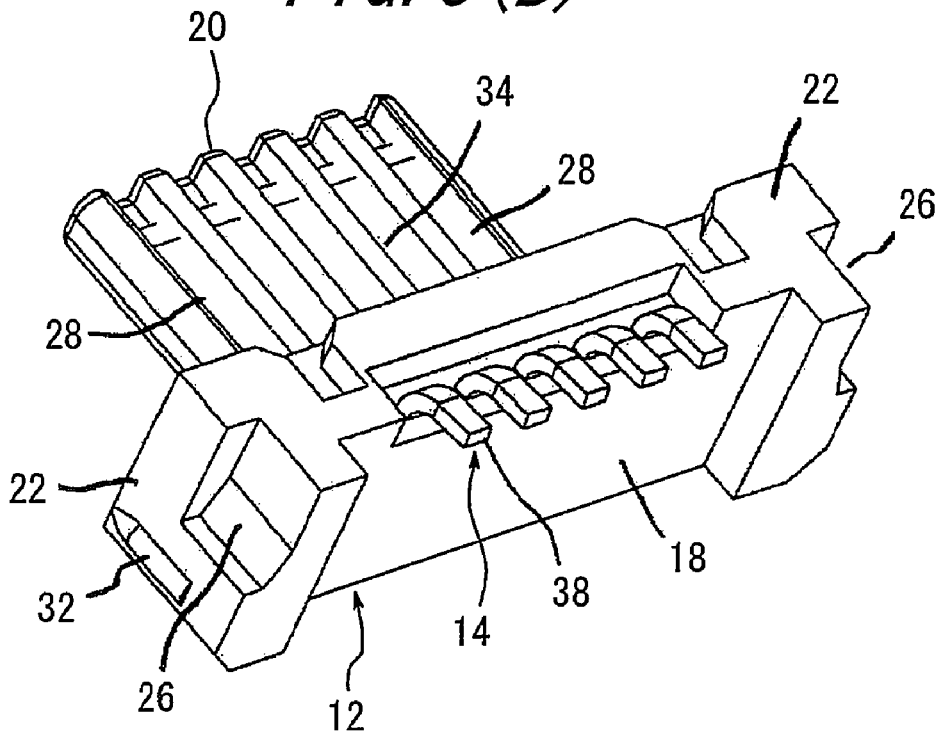
Figure 4:
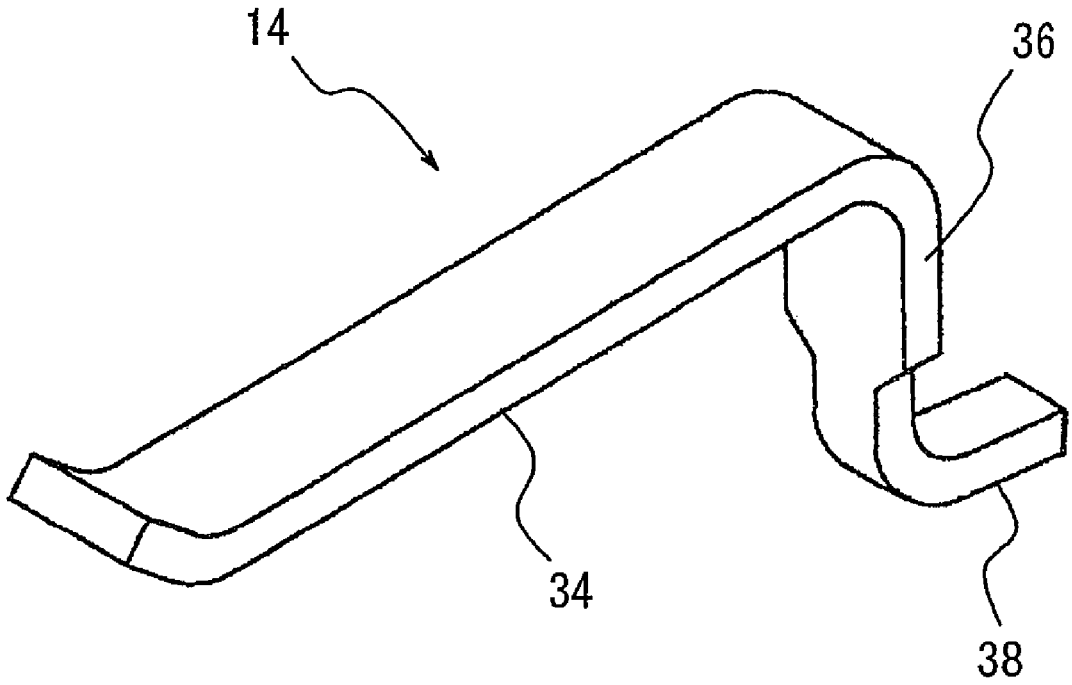
FIG. 4 is a perspective view of a contact used in the electrical connector according to the invention.
Figure 5A:
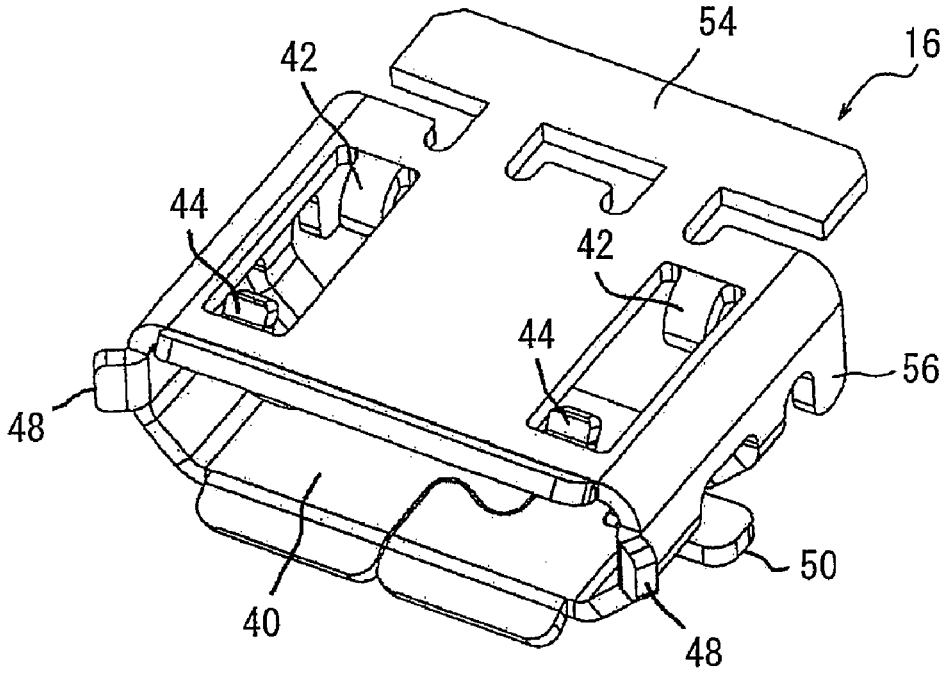
FIG. 5 (A) is a perspective view of a shell of the electrical connector according to the invention before the housing has been installed, viewed from the fitting opening side.
Figure 5B:
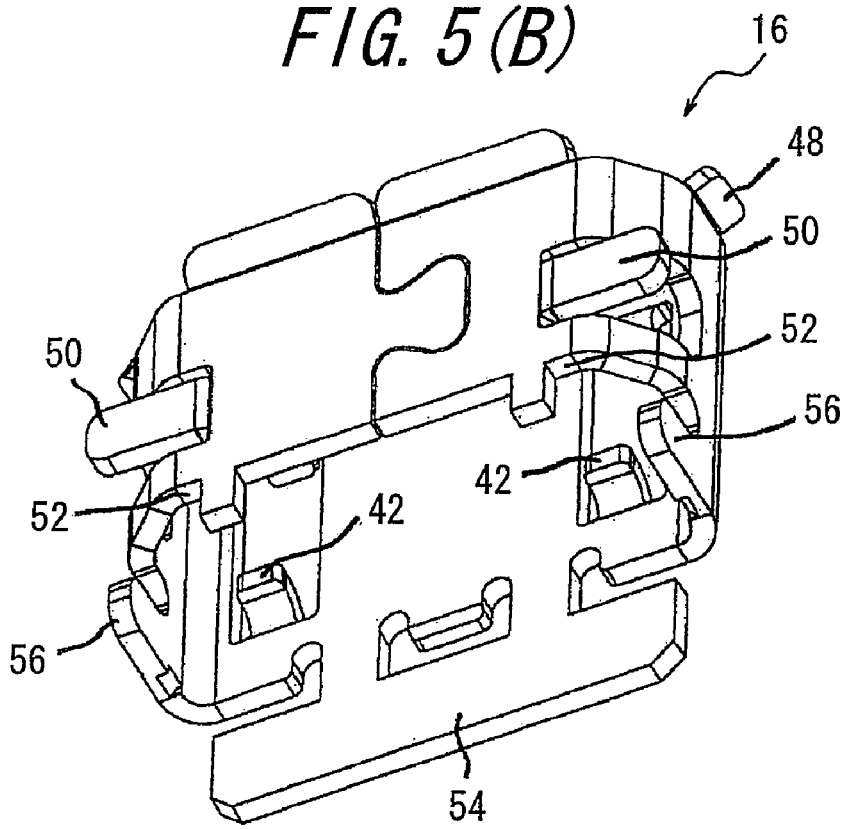
Figure 7A:
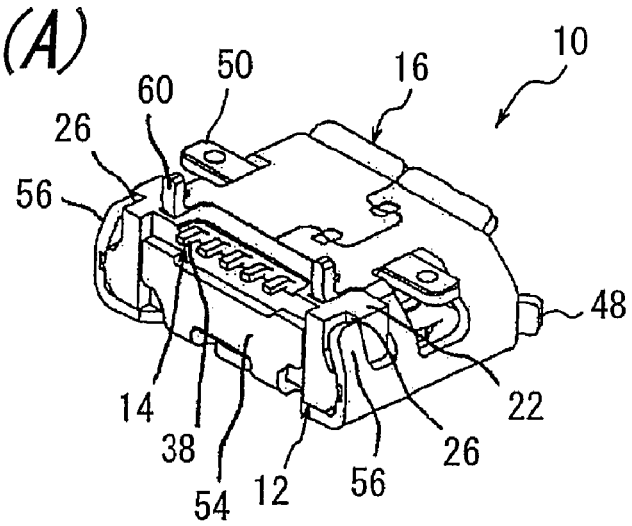
FIG. 7 (A) is a perspective view of another electrical connector viewed from the side connecting to a substrate.
Figure 7B:
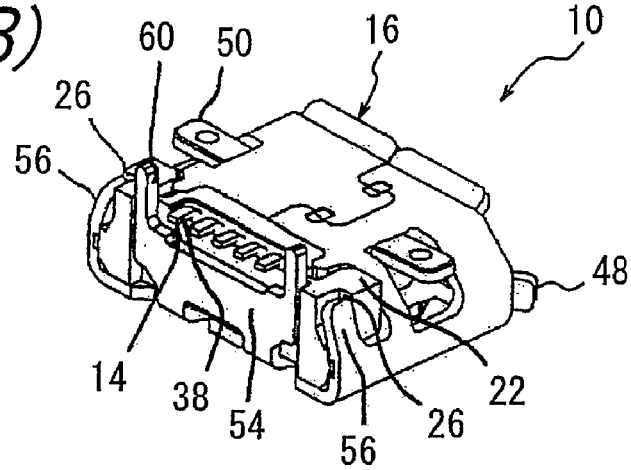
Figure 7C:
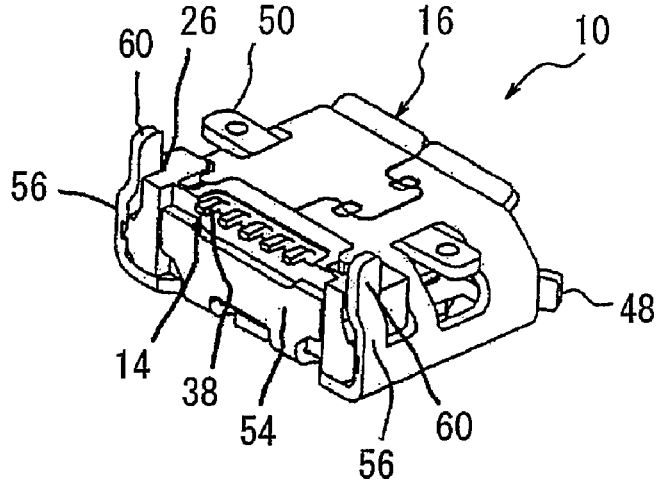
Figure 8A:
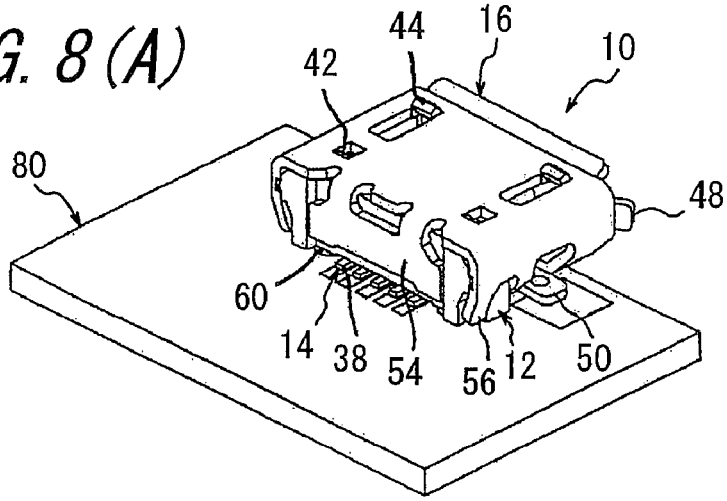
FIG. 8 (A) is a perspective view of the electrical connector shown in FIG. 7 (A) connected to the substrate.
Figure 8B:
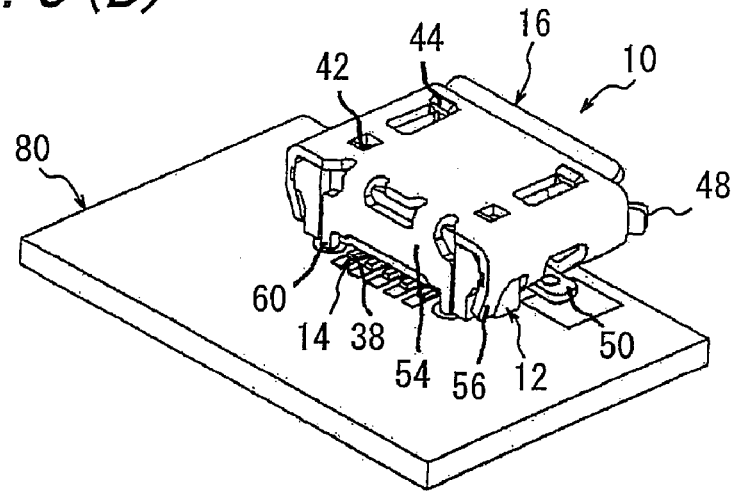
Figure 8C:
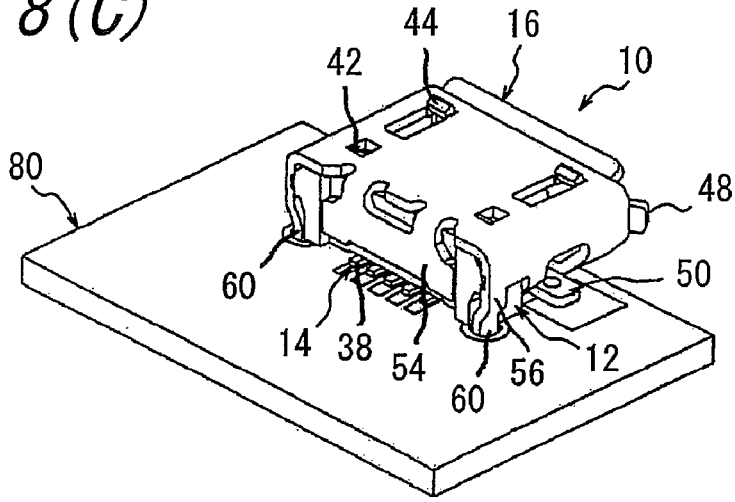

The electrical connector 10 according to the invention will be explained with reference to FIGS. 1 to 5 (B). FIG. 1 is a perspective view of the electrical connector according to the invention connected to a substrate viewed from its fitting side. FIG. 2 (A) is a perspective view of a shell of the electrical connector viewed from the fitting side, while FIG. 2 (B) is a perspective view of the shell viewed from its connecting side. FIG. 3 (A) is a perspective view of a housing of the electrical connector with contacts inserted, viewed from the fitting side, and FIG. 3 (B) is a perspective view of the housing with the contacts inserted, viewed from the connecting side. FIG. 4 is a perspective view of the contact. FIG. 5 (A) is a perspective view of the shell viewed from the side of the fitting opening before the housing is inserted, while FIG. 5 (B) is a perspective view of the shell viewed from the connecting side before the housing is inserted. FIG. 6 (A) is a perspective view of the shell only viewed from the connecting side for explaining slits of the shell, and FIG. 6 (B) is a perspective view of the electrical connector with its housing being pushed by plate-shaped pieces viewed from the connecting side. FIG. 7 (A) is a perspective view of another electrical connector different from that shown in FIG. 1, viewed from the side connecting to a substrate, while FIG. 7 (B) is a further electrical connector different from that shown in FIG. 7 (A), viewed from the side connecting the electrical connector to a substrate, while FIG. 7 (C) is an electrical connector different from those shown in FIGS. 7 (A) and 7 (B), viewed from the side connecting the electrical connector to a substrate. FIG. 8 (A) is a perspective view of the electrical connector shown in FIG. 7 (A) connected to the substitute;

FIG. 8 (B) is a perspective view of the electrical connector shown in FIG. 7 (B) connected to the substitute; and FIG. 8 (C) is a perspective view of the electrical connector shown in FIG. 7 (C) connected to the substitute.

The electrical connector 10 according to the invention comprises at least a plurality of contacts 14, a housing 12, and a shell 16.

First, the housing 12 will be explained, which is an important aspect of the invention. The housing 12 is formed from an electrically insulating plastic material by means of the injection molding of the known technique. The materials for the housing 12 may be suitably selected in consideration of dimensional stability, workability, manufacturing cost, and the like and generally include polybutylene terephthalate (PBT), polyamide (66PA or 46PA), liquid crystal polymer (LCP), polycarbonate (PC) and the like and combination thereof. Said housing 12 includes a main body 18, a fitting portion 20 extending from said main body 18 in the fitting direction, and flanges 22 provided at longitudinal ends of the main body 18.

In said housing 12, said contacts 14 are held (fixed) by integral molding, press-fitting, hooking or the like. In the embodiment, the contacts are held in the housing by the integral molding (molding the housing in a mold in which the contacts have been previously arranged) in consideration of stability of connection, dimensional stability, miniaturization of the connector, and the like. Therefore, said housing 12 is formed in its fitting portion 20 with inserting grooves 28 for exposing contact portions 34 of said contacts 14 and holding holes 30 for positioning said contact portions 34 of said contacts 14 at predetermined positions.

The shape and size of said inserting grooves 28 may be any ones insofar as the inserting grooves 28 enable said contact portions 34 of said contacts 14 to be exposed to obtain stable connection between the contact portions 34 and mating objects, and may be suitably designed taking into account the stability of connection, strength of said housing 12, contact positions with the mating objects, and the like. In the embodiment, the inserting grooves are substantially rectangular in consideration of the above.

The shape and size of said holding holes 30 may be any ones so long as the holding holes 30 enable said contact portion 34 of said contacts 14 to be positioned at the predetermined positions to obtain stable connection between the contact portions 34 and the mating objects and may be suitably designed in consideration of the stability of connection, strength of the housing 12, contact positions with the mating objects, ease in production of dies and the like. In the embodiment, the holding holes are substantially rectangular in consideration of the above.

Further, said housing 12 is provided with anchoring portions 24 in said flanges 22 on the fitting side on the side of said holding holes 30. Said anchoring portions 24 are adapted to engage engaging pieces 42 of said shell 16, thereby ensuring the positioning and increasing the strength of the housing and shell upon fitting with the mating connector. The shape, size and positions of said anchoring portions 24 may be any ones insofar as the anchoring portions correspond to and engage the engaging pieces 42, and may be suitably designed taking into account the positioning, strength, stability of connection and the like when fitting with a mating connector. In the embodiment, the anchoring portions 24 are recesses substantially bounded by rectangular faces in consideration of the workability of said engaging pieces 42 of said shell 16 and the functions described above.

Moreover, said housing 12 is provided with press-fitting portions (crush ribs) 32 at predetermined positions on said main body 18, and said flanges 22 for press-fitting the housing 12 into said shell 16, thereby securely positioning the housing 12 relative to the shell 16. The sizes and positions of said press-fitting portions 32 may be suitably designed in consideration of the functions described above, holding force, and the like. In the embodiment, the three press-fitting portions 32 are provided, that is, one is provided on the upper surface of the main body 18 viewed in FIG. 3 (A) and the remaining two are provided on the outer surfaces of both the longitudinal ends of the main body 18 of the housing 12, respectively.

Further, said housing 12 is provided with anchoring grooves 26 in the flanges 22 on the side opposite from the fitting side on its upper side viewed in FIG. 3 (B). Said anchoring grooves 26 are adapted to engage plate-shaped pieces 56 of said shell 16 so that said housing 12 is securely positioned in the shell 16, thereby holding the housing 12 relative to the shell. The shape, size and positions of said anchoring grooves 26 may be any ones insofar as they correspond to and can engage the plate-shaped pieces 56 of said shell 16 and may be suitably designed taking into account the positioning and holding force for the housing 12 and stability of connection with a mating connector. In the embodiment, the anchoring grooves are recesses substantially bounded by rectangular faces in consideration of the workability of said plate-shaped pieces 56 of said shell 16 and the functions described above.

The shell 16 will then be explained, which is another important aspect of the invention. The shell 16 is made of a metal and formed by means of the press-working of the known technique. Preferred metals from which to form said shell 16 include brass, beryllium copper, phosphor bronze and the like which are suitably selected taking into account dimensional stability, workability, manufacturing cost, and the like. Said shell 16 is substantially box-shaped and forms with the housing 12 a fitting opening 40 for inserting the mating connector thereinto. The shape and size of said fitting opening 40 need only be able to receive the mating connector and may be suitably designed in consideration of the shape of the mating connector.

Said shell 16 is provided with the engaging pieces 42 at locations corresponding to said anchoring portions 24 of said housing 12. The engaging pieces 42 are adapted to engage the anchoring portions 24 of said housing, thereby ensuring the positioning of the housing and increasing the strengths of the shell and housing upon fitting with the mating connector. The shape, size and positions of said engaging pieces 42 may be any ones so long as the engaging pieces 42 correspond to and can engage said anchoring portions 24, and may be suitably designed in consideration of positioning, strengths, stability of connection and the like when fitting with the mating connector. In the embodiment, the engaging pieces 42 are bent into the form of an L-shape taking into account the function described above and workability.

Further, the shell 16 is provided with the plate-shaped pieces 56 at locations corresponding to said anchoring grooves 26 of said housing 12. The plate-shaped pieces 56 are adapted to engage said anchoring grooves 26 of said housing 12, thereby ensuring the positioning and holding of said housing 12.

The shape, size and positions of said plate-shaped pieces 56 may be any ones insofar as the plate-shaped pieces 56 correspond to and can engage said anchoring grooves 26 of said housing 12, and may be suitably designed taking into account the positioning and holding force for the housing and stability of connection with the mating connector. In the embodiment, the plate-shaped pieces 56 are substantially plate-shaped in consideration of the functions described above and the workability of the shell. The plate-shaped pieces 56 are bent inwardly when the housing 12 is held by the shell.

Figure 6A:
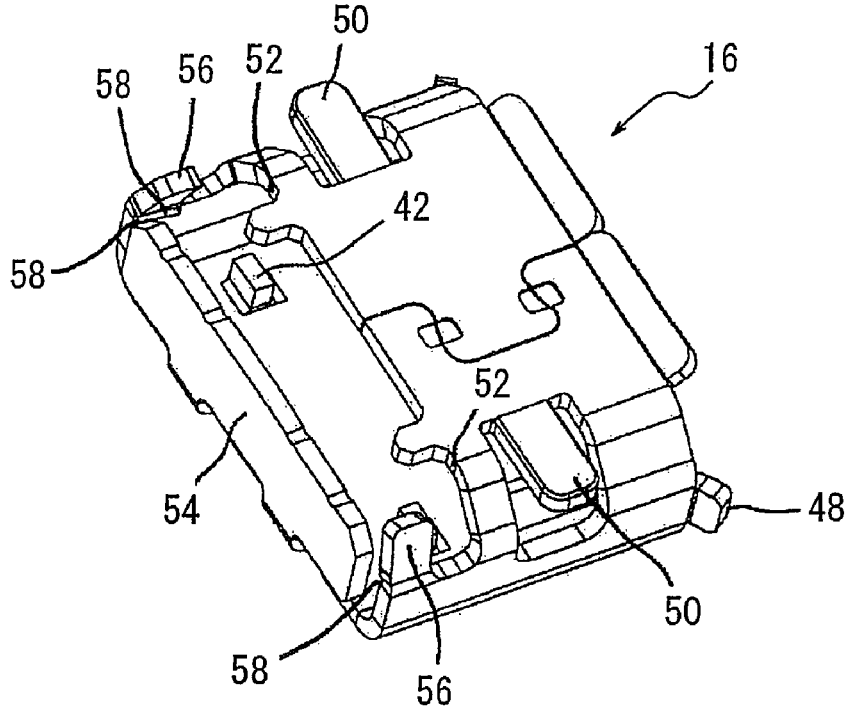
FIG. 6 (A) is a perspective view of the shell shown as a single member viewed from the connecting side for explaining the slits formed in the shell.
Figure 6B:
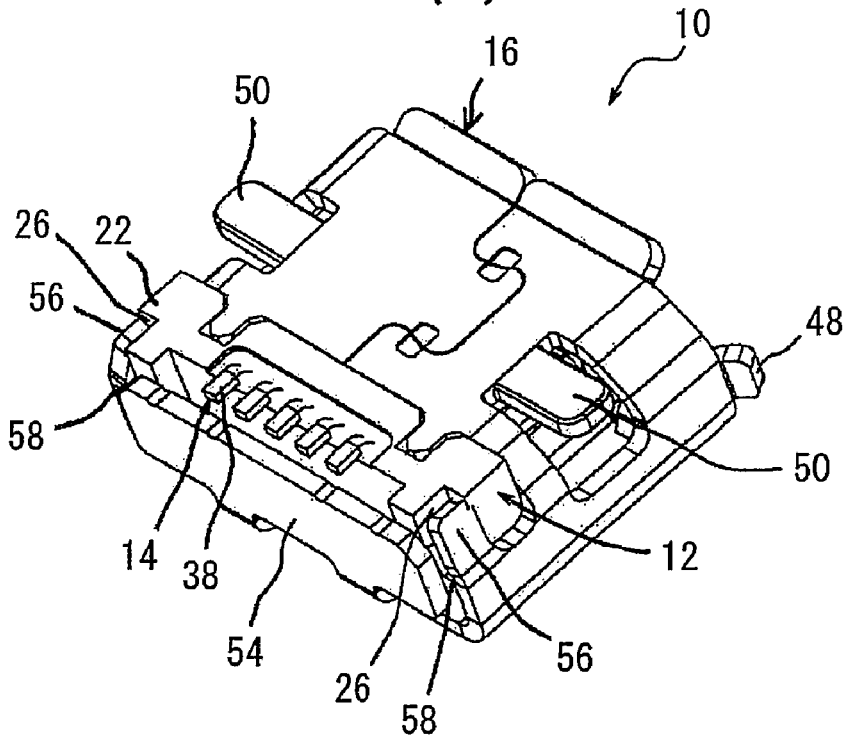

As shown in FIG. 6A, said plate-shaped pieces 56 of said shell 16 are each formed with a slit 58 extending obliquely for pushing the housing inwardly when the plate-shaped pieces 56 are bent. The slits 58 serve to push said housing inwardly upon the plate-shaped pieces 56 being bent. The shape, size and positions of said slits 58 may be suitably designed in consideration of the function described above, and strength, workability and the like of the shell. In the embodiment, said slits 58 each extend over the whole plate-shaped piece obliquely toward said fitting opening 40.

Moreover, said shell 16 is provided with abutment faces 52 against which said housing 12 abuts. Said flanges 22 of said housing 12 abut with their end faces against the abutment faces 52, thereby ensuring the positioning of the housing relative to the shell 16 and preventing the housing from being displaced toward the fitting opening 40. In other words, when said housing 12 is pushed inwardly upon said plate-shaped pieces 56 being bent, said flanges 22 of said housing 12 abut with their end faces against the abutment faces 52, thereby positioning said housing 12 relative to the shell 16. The abutment faces 52 may be suitably designed in consideration of the function described above and the strength of the shell 16.

Further, said shell 16 is provided with guide portions 48 along the outer circumference of said fitting opening 40 for guiding the mating connector into the fitting opening 40. The guide portions are provided so as to enable the mating connector to be guided.

Moreover, said shell 16 is provided with mating engaging portions 44 adapted to engage the mating connector. The mating engaging portions 44 engage the mating connector upon it being fitted to hold the electrical connector 10 and the mating connector securely.

Further, said shell 16 is provided with an EMI countermeasure wall 54 on the opposite side of the fitting opening 40 for measures against static electricity. Said housing 12 is covered by the shell of a metal for a countermeasure against the static electricity. As it is desirable to cover the housing in its entirety by a metal member, said EMI countermeasure wall 54 is provided on the opposite side of said fitting opening 40. The shape and size of said EMI countermeasure wall 54 may be suitably designed in consideration of such a function, workability, strength, and the like.

Moreover, said shell 16 is provided with tabs 50 at predetermined positions for mounting the shell 16 on a substrate 80. The tabs 50 serve to mount the electrical connector 10 on the substrate more strongly. The tabs 50 are of a surface mounting (SMT) type in the embodiment, but they may be of a dip type (not shown). The dip type is stronger than the surface mounting type so that the housing 12 is not moved even when a mating connector bumps against the electrical connector 10. The positions, size and shape of said tabs 50 may be suitably designed taking into account the function of the tabs, circuits and occupied area of the substrate, workability, strength and the like of the shell.

Finally, the contacts 14 will be explained. The contacts 14 are made of a metal and formed by means of the press-working of the known technique. Preferred metals from which to form said contacts 14 include brass, beryllium copper, phosphor bronze and the like which comply with the requirements as to dimensional stability, electric conductivity, and the like. Said contact 14 mainly comprises a contact portion 34 adapted to contact a mating connector, a fixed portion 36 (which is to be embedded in the housing by the integral molding) held by said housing 12, and a connection portion 38 to be connected to the substrate 80, and is substantially in the form of a crank. Said contact portion 34 is adapted to contact a contact or the like of the mating connector, and the shape and size of the contact portion may be suitably designed taking into account the contact stability and pressure when contacting the mating contact, and workability and the like of the contact. The contact portion 34 is plate-shaped in the embodiment. Said fixed portion 36 is held in said housing 12, and is held by integral molding with the housing in the embodiment. Said connection portion 38 is connected to the substrate 80, and the shape of the connection portion 38 may be suitably designed in consideration of specifications, a mating object, connecting method, and the like. The connecting portion 38 is of a surface mounting type (SMT), and connected to the substrate by soldering such as reflow soldering. Although the surface mounting type is employed for the contacts 14 in the embodiment, the dip type may be employed depending upon specifications, required strengths and the like.

Another electrical connector will be explained with reference to FIGS. 7 (A) and 8(A). A housing 12 and contacts 14 will not be described because they are substantially similar to those described in the above embodiment. Only differences between a shell of this embodiment and the shells described above will be explained hereafter. The shell 16 in this embodiment is provided with projecting pieces 60 formed integrally therewith on the opposite side of the fitting opening 40. Said projecting pieces 60 are connected to a substrate 80 to increase the bonding strength of the shell to the substrate so that the housing 12 is prevented from being displaced when a mating connector bumps against the electrical connector 10. In the embodiment, there are provided two projecting pieces 60 on both sides in the width direction on the opposite side of the fitting opening 40. The projecting pieces 60 are bent into substantially an L-shape as shown in FIG. 7 (A). The positions, size, and shape may be suitably designed taking into account miniaturization of the connector, circuits of the substrate, increase in strength upon fitting, and the like.

A further electrical connector will be explained with reference to FIGS. 7 (B) and 8 (B). A housing 12 and contacts 14 will not be described because they are substantially similar to those described in the above embodiments. Only differences between a shell of this embodiment and the shells described above will be explained. The shell 16 is provided with a static electricity countermeasure wall (EMI countermeasure wall) 54 on the opposite side of the fitting opening 40 for covering the connecting side of said housing 12, and further the static electricity countermeasure wall 54 is provided with projecting pieces 60 integrally formed with the wall 54. Said projecting pieces 60 are connected to a substrate 80 to increase the bonding strength of the shell to the substrate so that said housing 12 is prevented from being displaced when a mating connector bumps against the electrical connector 10 and the countermeasure against the static electricity is achieved. In the embodiment, there are provided two projecting pieces 60 on both sides in the width direction on the opposite side of the fitting opening 40. The projecting pieces 60 extend vertically from said static electricity countermeasure wall (EMI countermeasure wall) 54 as shown in FIG. 7 (B). The positions, size and shape of said projecting pieces 60 may be suitably designed taking into account the miniaturization of the connector, circuits of a substrate, increase in strength upon fitting, and the like.

An electrical connector will be explained with reference to FIGS. 7 (C) and 8 (C), which is different from those shown in FIGS. 1 and 7 (A) and 7 (B). A housing 12 and contacts 14 will not be described because they are substantially similar to those described in the above embodiments. Only differences between a shell of this embodiment and the shells described above will be explained. The shell 16 is provided on the opposite side of its fitting opening 40 with projecting pieces 60 formed integrally with the shell 16. Said projecting pieces 60 are connected to a substrate 80 to increase the bonding strength of the shell to the substrate so that said housing 12 is prevented from being displaced when a mating connector bumps against the electrical connector 10. The projecting pieces 60 are formed by further extending parts of the plate-shaped pieces 56 toward the substrate 80. The positions, size and shape of said projecting pieces 60 may be suitably designed in consideration of the function and positions of the plate-shaped pieces 56, the miniaturization of the connector, circuit of the substrate, increase in strength upon fitting, and the like.

Examples of applications of the invention are electrical connectors for use in electric and electronic appliances such as mobile phones, and particularly electrical connectors with the structure preventing their housing from being pushed when being fitted with a mating connector.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. An electrical connector to be detachably fitted with a mating connector, comprising a plurality of contacts, a housing for arranging and holding said contacts, and a shell covering said housing and forming with said housing a fitting opening for said mating connector, wherein said shell is provided with at least one engaging piece and said housing is provided with an anchoring portion at a location corresponding to said engaging piece to cause said anchoring portion to engage said engaging piece, thereby restraining said housing from being displaced in the direction opposite to the fitting direction when the electrical connector is being fitted with the mating connector; and wherein said shell is provided with plate-shaped pieces on both sides in its width direction on the opposite side of said fitting opening, and said plate-shaped pieces are each formed on the inner side with an oblique slit so that said plate-shaped pieces are bent along said oblique slits to push said housing toward the fitting opening by said plate-shaped pieces for pushing and holding said housing toward the fitting opening.

2. The electrical connector as claimed in claim 1, wherein said shell is provided with at least one abutment face and said housing is brought into abutment against said abutment face, thereby positioning said housing in the fitting direction.

3. The electrical connector as claimed in claim 1, wherein said shell is provided with a projecting piece formed integrally therewith on the opposite side of the fitting opening, and said projecting piece is connected to a substrate.

4. The electrical connector as claimed in claim 1, wherein said shell is provided on the opposite side of the fitting opening with a static electricity countermeasure wall (EMI countermeasure wall) covering the connecting side of said housing, and said static electricity countermeasure wall (EMI countermeasure wall) is provided with a projecting piece formed integrally therewith, said projecting piece being connected to a substrate.

5. The electrical connector as claimed in claim 1, wherein said plate-shaped piece is further extended toward said substrate to form a projecting piece.

6. The electrical connector as claimed in claim 2, wherein said shell is provided with a projecting piece formed integrally therewith on the opposite side of the fitting opening, and said projecting piece is connected to a substrate.

7. The electrical connector as claimed in claim 2, wherein said shell is provided on the opposite side of the fitting opening with a static electricity countermeasure wall (EMI countermeasure wall) covering the connecting side of said housing, and said static electricity countermeasure wall (EMI countermeasure wall) is provided with a projecting piece formed integrally therewith, said projecting piece being connected to a substrate.

8. The electrical connector as claimed in claim 3, wherein said shell is provided on the opposite side of the fitting opening with a static electricity countermeasure wall (EMI countermeasure wall) covering the connecting side of said housing, and said static electricity countermeasure wall (EMI countermeasure wall) is provided with a projecting piece formed integrally therewith, said projecting piece being connected to a substrate.

9. The electrical connector as claimed in claim 5, wherein said shell is provided on the opposite side of the fitting opening with a static electricity countermeasure wall (EMI countermeasure wall) covering the connecting side of said housing, and said static electricity countermeasure wall (EMI countermeasure wall) is provided with a projecting piece formed integrally therewith, said projecting piece being connected to a substrate.

10. The electrical connector as claimed in claim 6, wherein said shell is provided on the opposite side of the fitting opening with a static electricity countermeasure wall (EMI countermeasure wall) covering the connecting side of said housing, and said static electricity countermeasure wall (EMI countermeasure wall) is provided with a projecting piece formed integrally therewith, said projecting piece being connected to a substrate.

11. The electrical connector as claimed in claim 2, wherein said plate-shaped piece is further extended toward said substrate to form a projecting piece.

12. The electrical connector as claimed in claim 3, wherein said plate-shaped piece is further extended toward said substrate to form said projecting piece.

13. The electrical connector as claimed in claim 7, wherein said plate-shaped piece is further extended toward said substrate to form a projecting piece.

14. The electrical connector as claimed in claim 8, wherein said plate-shaped piece is further extended toward said substrate to form said projecting piece.

15. An electrical connector to be detachably fitted with a mating connector, comprising a plurality of contacts, a housing for arranging and holding said contacts, and a shell covering said housing and forming with said housing a fitting opening for said mating connector, wherein said shell is provided with at least one engaging piece and said housing is provided with an anchoring portion at a location corresponding to said engaging piece to cause said anchoring portion to engage said engaging piece, thereby restraining said housing from being displaced in the direction opposite to the fitting direction when the electrical connector is being fitted with the mating connector; and wherein said shell is provided on the opposite side of the fitting opening with a static electricity countermeasure wall (EMI countermeasure wall) covering the connecting side of said housing, and said static electricity countermeasure wall (EMI countermeasure wall) is provided with a projecting piece formed integrally therewith, said projecting piece being connected to a substrate.

16. The electrical connector as claimed in claim 15, wherein said shell is provided with at least one abutment face and said housing is brought into abutment against said abutment face, thereby positioning said housing in the fitting direction.

17. The electrical connector as claimed in claim 15, wherein said shell is provided with a projecting piece formed integrally therewith on the opposite side of the fitting opening, and said projecting piece is connected to a substrate.

18. The electrical connector as claimed in claim 15, wherein said plate-shaped piece is further extended toward said substrate to form a projecting piece.

19. The electrical connector as claimed in claim 16, wherein said shell is provided with a projecting piece formed integrally therewith on the opposite side of the fitting opening, and said projecting piece is connected to a substrate.

20. The electrical connector as claimed in claim 17, wherein said plate-shaped piece is further extended toward said substrate to form said projecting piece.

21. The electrical connector as claimed in claim 19, wherein said plate-shaped piece is further extended toward said substrate to form said projecting piece.

* * * * *